United States Patent [19]

Smith et al.

[11] Patent Number: 4,459,706

[45] Date of Patent: Jul. 17, 1984

[54] DISPOSABLE PROTECTIVE CAP AND PROCESS AND APPARATUS FOR ITS PRODUCTION

[75] Inventors: Rory J. M. Smith, Hebden; Brenda M. Sykes, Cross Hills; Roger S. Terry, Keighley; David A. Coates; Philip B. Gower, both of Skipton, all of England

[73] Assignee: Johnson & Johnson, New Brunswick, N.J.

[21] Appl. No.: 287,832

[22] Filed: Jul. 29, 1981

[30] Foreign Application Priority Data

Jul. 31, 1980 [GB] United Kingdom ..... 8025013

[51] Int. Cl.[3] ..... A42B 1/04

[52] U.S. Cl. ..... 2/195; 2/63

[58] Field of Search ..... 2/195, 198, 200, 194, 2/192, 63

[56] References Cited

U.S. PATENT DOCUMENTS 1,796,638 3/1931 Tuggy ..... 2/63

3,403,409 10/1968 Wagenfeld ..... 2/198

*Primary Examiner*—Doris L. Troutman

[57] ABSTRACT

The invention relates to a disposable protective cap, particularly a disposable nurse's cap. The cap is formed from a rectangular sheet of nonwoven fabric having a pair of opposed side edges and a pair of opposed end edges. The sheet is pleated along longitudinal fold-lines parallel to the opposed pair of side edges and the pair of opposed side edges are secured together. The pleats are secured together at one end of the pleated sheet and the other end of the pleated sheet is at least partly elasticated to provide an expandable and contractable opening for the head. The invention also provides an apparatus and method for producing the cap and in particular an apparatus and method for the continuous production of the cap.

17 Claims, 17 Drawing Figures

DISPOSABLE PROTECTIVE CAP AND PROCESS AND APPARATUS FOR ITS PRODUCTION

This invention relates to a disposable protective cap, especially a nurse's disposable cap, and a process and apparatus for its production.

Disposable, i.e. single-use, surgical headwear is now in common use. Its function is securely to contain the hair and thereby prevent hair and skin particles from contaminating the patient. One well-known nurse's disposable cap is made of non-woven fabric and comprises a circular crown-piece to which is stitched a strip constituting a head-band which is elasticated along part of its rim or edge not stitched to the crown piece.

The production of this cap is wasteful of fabric as circles of fabric are cut from a nonwoven fabric web leaving unusable areas of fabric therebetween. Moreover, the stitching together of the two pieces of fabric required the matching of edges and is a precision operation which has to be effected by skilled machinists. This naturally leads to some variation in the size of the cap and is labour intensive.

Another known nurse's disposable cap comprises a flattened tube of relatively heavy stretch-bonded nonwoven fabric which tube is folded into a number of narrow rectangular folds, the folds being secured together at one end of the tube by a metal rivet. The tube is opened up at the other end to fit it over the head, so that the cap looks something like a tea-cosy. Nurses find it uncomfortable to wear, and that it collapses down on the head and spoils their hair-styles.

The present invention provides a disposable protective cap, particularly a nurse's disposable cap, formed from a rectangular sheet of nonwoven fabric having a pair of opposed side edges and a pair of opposed end edges, said sheet being pleated along longitudinal fold-lines parallel to said opposed pair of side edges, and said pair of opposed side edges being secured together, the pleats being secured together at one end of said pleated sheet and the other end of said pleated sheet being at least partly elasticated to provide an expandable and contractable opening for the head.

A disposable nurse's cap in accordance with the present invention is made of one rectangular piece of nonwoven fabric which is cut from a web thereof without waste. Moreover it lends itself to automatic production, no skilled operatives being required for its production. This leads to uniformity in the size of the cap. The cap of the present invention can be packed flat for ease of transportation. It is comfortable to wear, remains in place, and secures the hair without crushing the hair-style.

The term "rectangular" used in this specification means precisely or substantially rectangular.

Preferably the pleated sheet is invaginated prior to use, that is to say the end at which the pleats are secured is pushed back through the pleated sheet and through the opening. The effect of this is to hide the means of securement, e.g. lines of stitching, and to provide a neater appearance.

The open end of the pleated sheet may be wholly or partly elasticated. If partly elasticated, the elasticated portion is arranged, in use, at the rear of the head so that it keeps the hair in place, and the unelasticated portion constitutes a closely fitting head-band over the forehead. Preferably the open end is partly elasticated by two lengths of elastic, each length of elastic preferably being in the form of an elastic filament heat bonded to the fabric. In a preferred aspect of the invention the elastication is formed by a twist of elastic filament and thermoplastic thread, which thermoplastic is heat bonded to the fabric.

The nonwoven, fabric may comprise natural and/or man-made fibres, e.g. cellulosic fibres or synthetic fibres. Paper may be used as the nonwoven fabric. However, the nonwoven fabric is preferably a viscose rayon nonwoven fabric. The nonwoven fabric may consist of, or include, other textile fibres, especially when a heat-sealable fabric is required. For example, suitable heat-sealable fibres are polyethylene-coated polypropylene fibres sold by the Chisso Corporation of Japan.

The nonwoven fabric may be a rearranged or "bundled" nonwoven fabric, e.g. "KEYBAK" bundled nonwoven fabric, or may be a plain nonwoven fabric. Alternatively it could be a random laid nonwoven fabric.

The opposed side edges and the pleats may be secured by stitching, but other methods of securement may be employed, for example, bonding using a hot-melt adhesive, heat-sealing (when the nonwoven fabric comprises heat-sealable fibres), and ultrasonic or dielectric welding. Other methods of securement such as stapling may be used.

The present invention further provides a method of producing a disposable protective cap, particularly a nurse's disposable cap, comprising the steps of pleating a rectangular sheet of nonwoven fabric along longitudinal fold lines parallel to the opposed side edges of said sheet, securing together the side edges of a length of said web, securing together the pleats at one end of the pleated sheet, and at least partly elasticating the other end of said sheet to provide an expandable and contractable opening (for the head) into said pleated and secured sheet.

In the method of the present invention, the elastication step may be effected prior to or after the pleating step.

The method according to the present invention may be a continuous one, and according to this aspect of the present invention there is provided a method of producing a disposable protective cap, particularly a nurse's disposable cap, comprising the steps of advancing a web of nonwoven fabric to a pleating station, pleating said web along longitudinal fold-lines parallel to the opposed side edges of said web, compacting the pleats together, securing together the side edges of a length of said pleated web, securing together the pleats of said pleated length at one end of said length, and severing said length from said web, and at least partly elasticating said web or said length transversely of said web or length to provide at the other end of said length, an expandable and contractable opening into said length.

Said length may be elasticated prior to or after the pleating step, preferably prior to the pleating step.

The present invention even further provides apparatus for producing a disposable protective cap, particularly a nurse's disposable cap, comprising folding means for pleating a rectangular sheet of nonwoven fabric along longitudinal fold-lines parallel to opposed side edges of said sheet, means for securing together said side edges of said sheet, means for securing together the pleats at one end of the pleated sheet, and means for at least partly elasticating the other end of said sheet.

Preferred apparatus in accordance with the present invention is arranged to form a production line, and according to this aspect of the present invention, the apparatus comprises means for at least partly elasticating the web of nonwoven fabric transversely of said web, means for advancing said elasticated web to a pleating station, means at said pleating station for pleating said elasticated web along longitudinal fold-lines parallel to opposed side edges of said web, means for compacting the pleats together, means for securing together the side edges of a length of said pleated web, means for securing together the pleats of said length at one end of said pleated length, and means for severing said length from said web.

The pleating means may comprise a plurality of intermeshed guide sheets. The guide spacing is reduced progressively so as to cause the pleats of the web to come closer together as the web advances through the pleating means. The pleating means may also comprise a pleating sheet upstream of said guide sheets, said pleating sheet being corrugated at its downstream end to guide the fabric into the intermeshed guide sheets.

The compacting means may comprise a roller over which the pleated fabric passes.

The means for securing together the longitudinal edges of the web may comprise a stationary sewing head through which the web is advanced, and the means for securing together the pleats may be a cross-sewing station through which the fabric is advanced adapted to cross-sew said pleats whilst the pleated fabric is moving.

The cross sewing station may comprise a sewing machine mounted on guide means, said guide means being adapted to move said sewing machine diagonally across the moving pleated fabric such that the component velocity of the sewing machine in the direction of pleated fabric movement is equal to the velocity of pleated fabric movement.

A preferred embodiment of a disposable nurse's cap and a process and apparatus for the production thereof will now be described, by way of example, with reference to the accompanying diagrammatic drawings in which.

In the drawings, like reference numerals indicate the same or similar parts.

Figure 1:
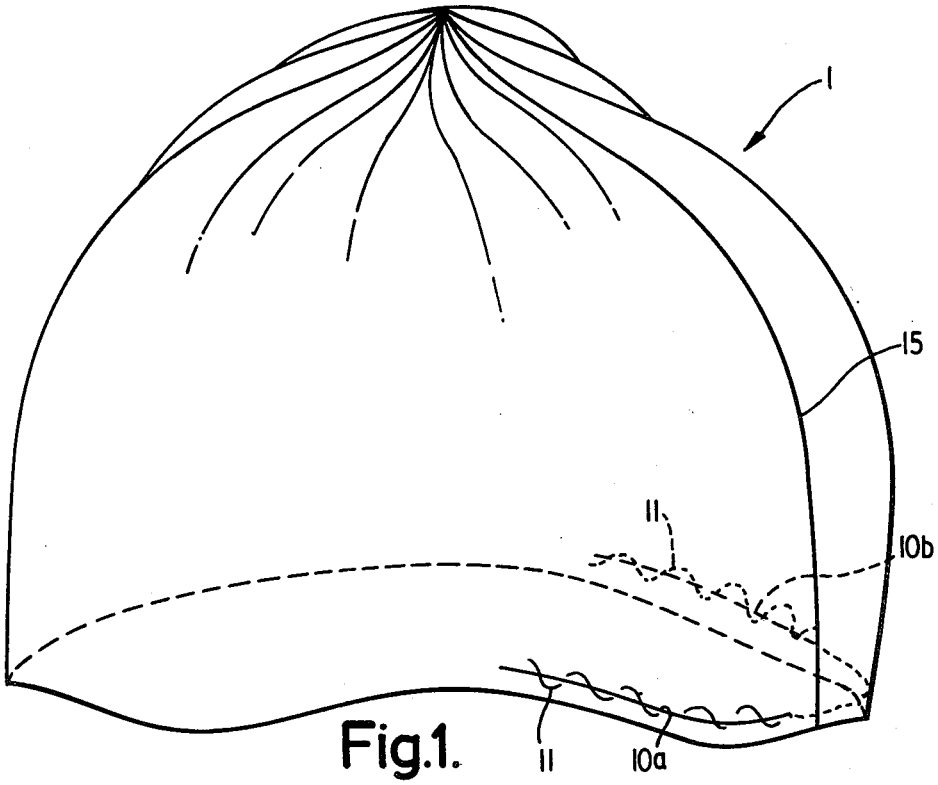
FIG. 1 is a prespective view of the disposable nurse's cap.
Figure 2:
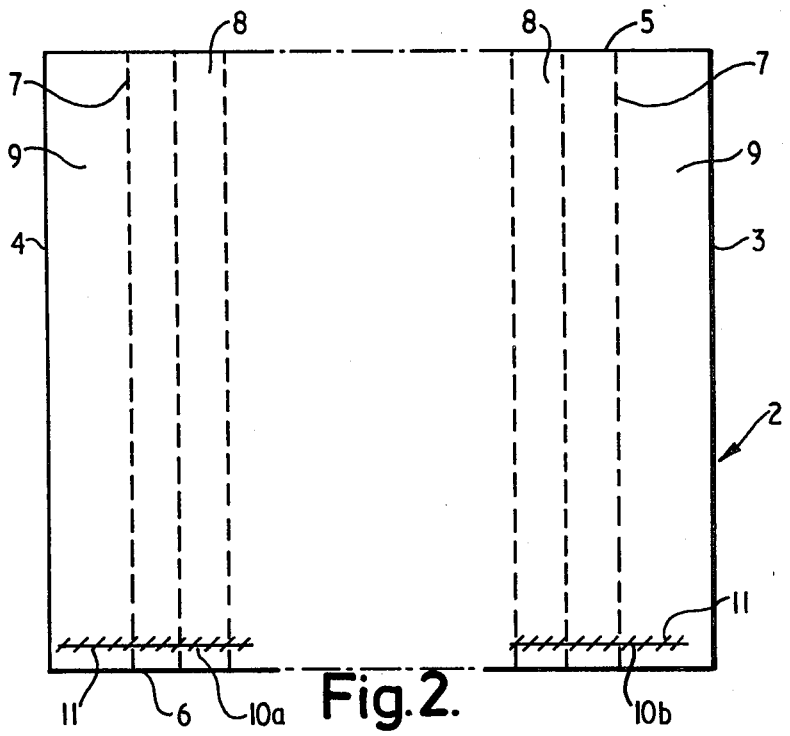
FIG. 2 is a plan view of a sheet of nonwoven fabric from which the cap is formed.

Referring to FIGS. 1 to 4 of the drawings, the nurse's disposable cap, shown generally at 1 in FIG. 1, is formed from a rectangular sheet 2 of nonwoven fabric shown in FIG. 2. The sheet 2 has a pair of opposed side edges 3, 4 and a pair of opposed end edges 5, 6. A plurality of longitudinal fold lines 7 parallel to said side edges 3, 4 are shown in outline extending longitudinally of the sheet 2, to define the precursors of inner pleats 8 and two outer pleats 9 which are slightly wider than the inner ones 8. Two spaced apart, lengths 10*a* and 10*b*, of elastic filaments are secured by heating thermoplastic thread 11 wound therearound to the sheet 2 close to the end edge 6. The lengths 10*a* and 10*b* of thread are secured to the sheet 2 in a stretched condition and is so shown; if it were allowed to relax, the sheet 2 would bunch up.

Figure 4:
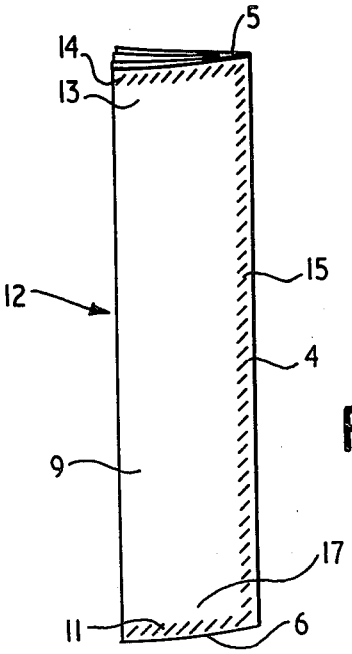
FIG. 4 is a view of said sheet after pleating, compacting and stitching.
Figure 3:
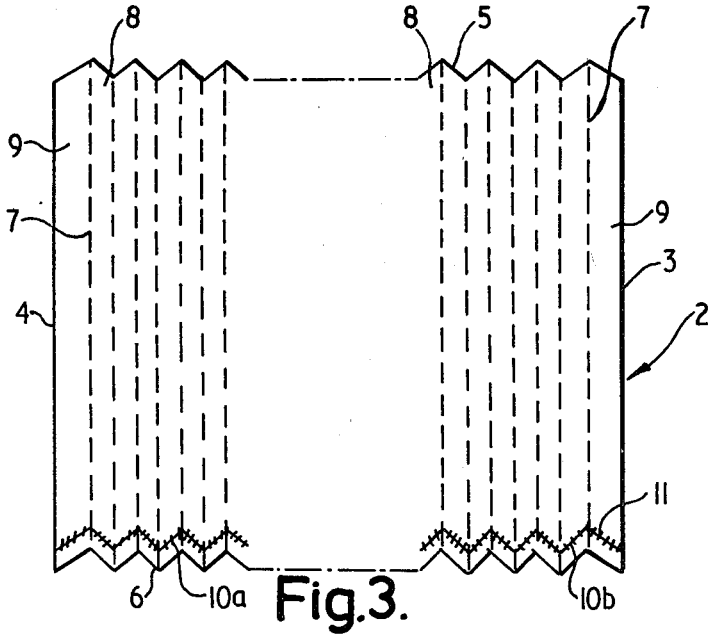
FIG. 3 is a view of said sheet after creasing.

As shown in FIG. 3, the sheet 2 is creased along the longitudinal fold-lines 7 to provide the pleats 8, 9 proper, as shown in FIG. 4. The pleats 8, 9 are compacted together to form a blank shown generally at 12. In the blank 12, the pleats 8, 9 are secured together at the upper end 13 by stitching 14 near the end edge 5, and the side edges 3, 4 are secured together by stitching 15, this being possible because of the greater width of the outer pleats 9 which, after compaction, slightly overlap the inner pleats 8. It will be appreciated that there is an opening 16 at the lower end 17 of the blank.

To erect the cap 1 prior to use, the blank 12 is invaginated by pushing the upper end 13 back through the opening 16 at the lower end 17 of the blank 12, the opening 16 being expandable and contractable by virtue of the elastication 10*a* and 10*b*. By placing the hands inside the invaginated blank and expanding the elasticated opening 16, the cap can be fitted over the head. In FIG. 1 the opening 16 for the head is shown expanded.

In use, the cap is found comfortable to wear, remains in place, and secures the hair without crushing it. If desired, the elastication 10*a* and 10*b* need not be in the form of two spaced apart lenths but may be a single length extending fully across the full width of the sheet 2 or across only a part thereof. When such a cap is worn, shown in FIG. 1, the elasticated lengths are arranged at the back of the head to keep the hair tucked underneath. The unelasticated portion constitutes a closely-fitting headband over the forehead by virtue of the elastication which is tensioned when the cap is worn.

A suitable lightweight, comformable, nonwoven fabric for the nurse's cap is "KEYBAK" bundled nonwoven fabric having a weight of about 10 to 50 g/m$^2$, e.g. 30 to 35 g/m$^2$. This fabric is a viscose rayon fabric bonded by an acrylic binder. The width of sheet 2 may be about 70 cm. and the length about 25 cms.

The nurse's disposable cap 1 may be produced automatically using the method and apparatus described hereinafter with reference to FIGS. 5 to 17.

A flat non-tubular web 18 of nonwoven fabric as above described having a width of about 70 cm. is advanced from a bulk roll thereof 19, over a first guide roller 20, under a dangling roller 21, up over guide roller 22 to an elastication station 23. Dangling roller 21 is slung between guide rollers 20 and 22 to maintain substantially constant tension in the web 18 as it enters the apparatus. Bulk roll is rotated intermittently so as to maintain dangling roller below the level of the guide rollers 20 and 22. The rotation of the bulk roll 19 may be controlled by any suitable means, e.g. an electrical sensor sensing the distance of the dangling roller 21 from the guide rollers 20 and 22, which sensing means controls a motor for rotation of the bulk roll 19.

At the elastication station 23 two lengths of elastic filaments 10*a* and 10*b* are heat bonded to the fabric in a direction normal to the direction of flow of material at predetermined intervals along the length. A detailed description of the elastication station is given hereinafter with reference to FIG. 8.

From the elastication station, the fabric passes to a pleating station 24 where the material is pleated along longitudinal fold-lines parallel to the side edges of the web 18, described more fully hereinafter. The pleated fabric is guided over roller 25 (which compacts the pleats together) to a longitudinal sewing station 26 wehre the two end edges of the outer pleats are stitched together continuously along the length of the pleated fabric.

From the longitudinal sewing station 26, the pleated fabric is turned through 90° at a cross-sewing station through which fabric is advanced just prior to a cross-sewing operation. At the cross-sewing station, the apparatus cross-sews the pleats preferably at right angles to the flow of pleated fabric across its width immediately downstream from each pair of elastic lengths provided in the fabric and the elastication station. In order to form this cross-sewing step, a sewing machine is provided on guide means, such as a slide, for movement diagonally e.g. at 45° to the general direction of the flow of the pleated fabric. This is discussed more fully with reference to FIG. 16 below.

From the cross-sewing station, the fabric passes through heated rollers 28 to iron the pleated fabric, and then each hat is produced by a rotary cutter 29 which severs the fabric between each cross stitch and elastication location. Each hat is then passed to a stacking station 30.

Figure 7:
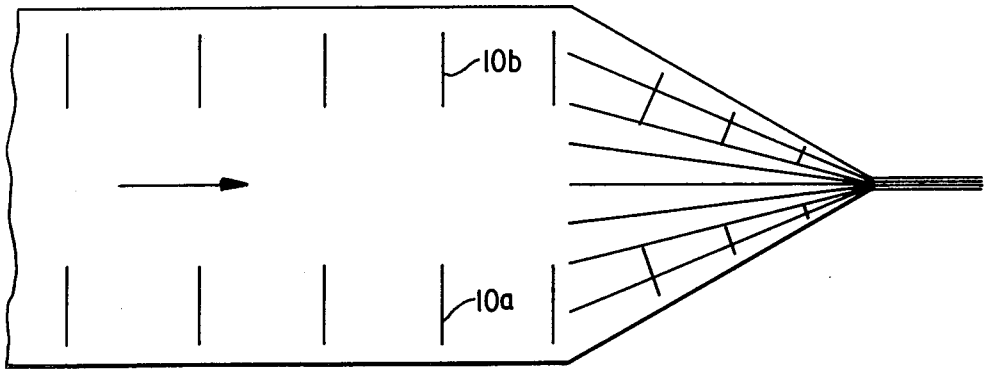
FIG. 7 is a flow-line of elasticated fabric feeding into and through a pleating station.
Figures 8, 9:
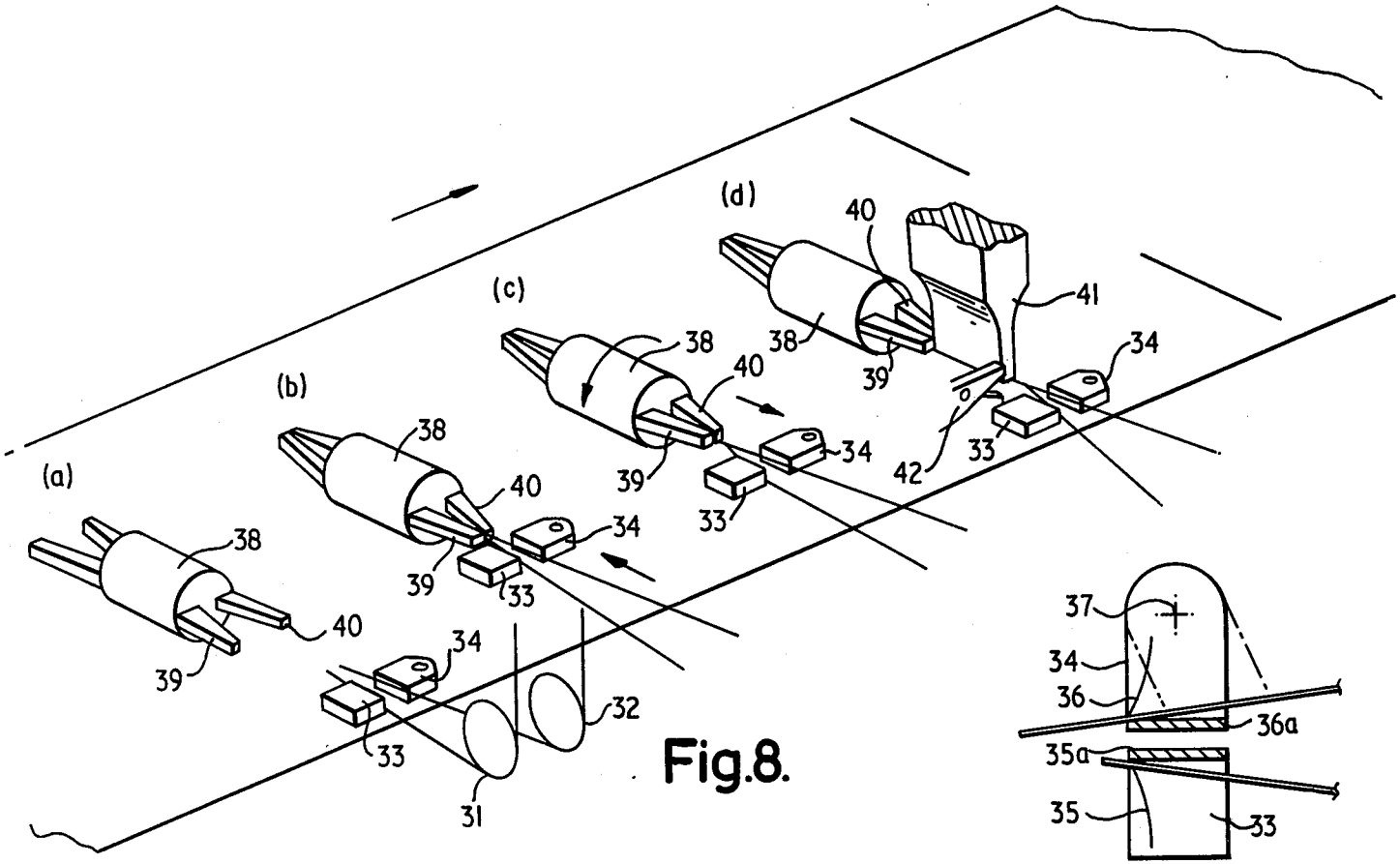
FIG. 8 is a prespective view of an elastication station.
FIG. 9 is a plan view of a component of the elastication station.
Figure 10:
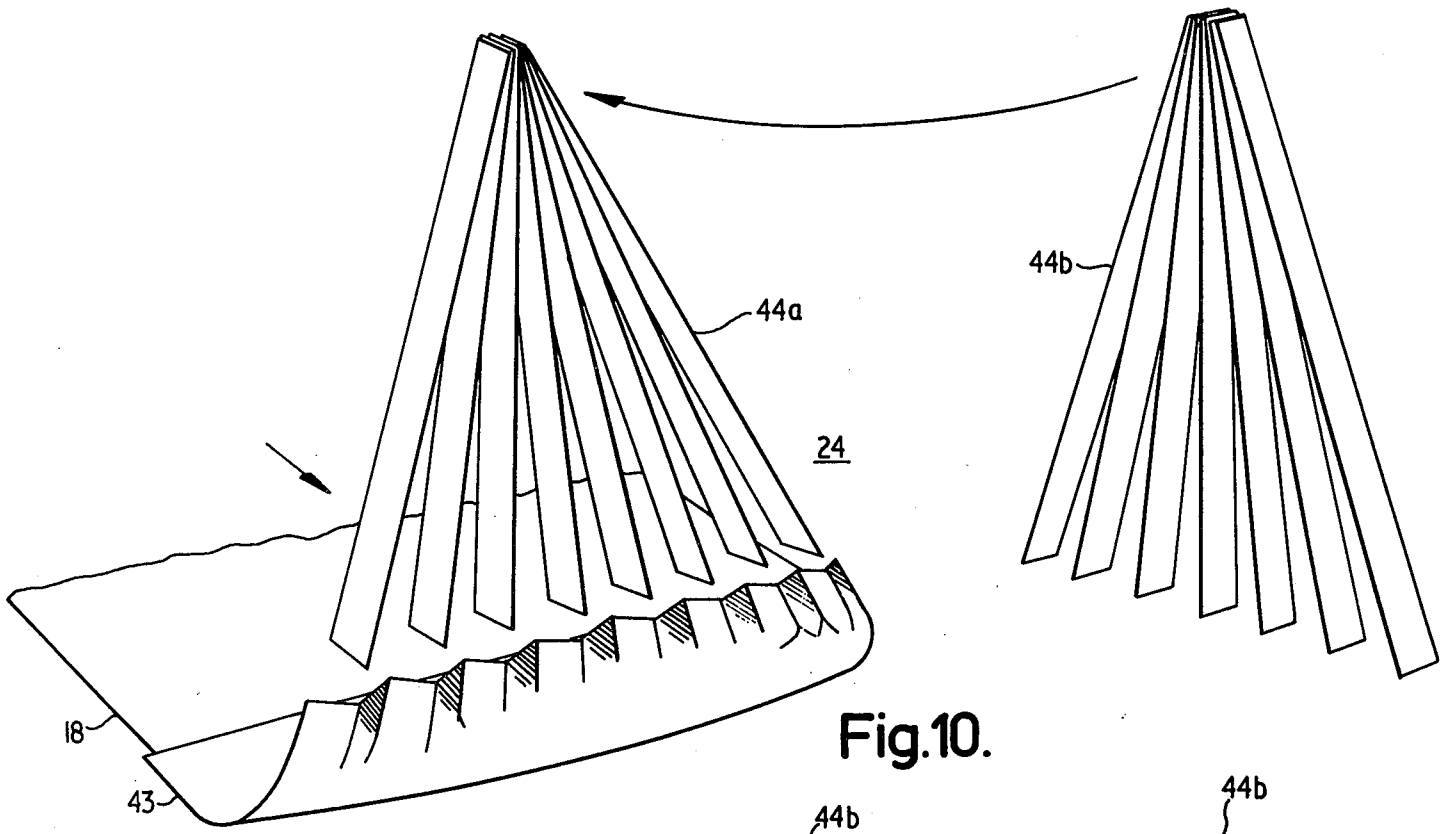
FIG. 10 is an exploded perspective view of the pleating station.

Referring now to FIGS. 7, 8 and 9, the elastication station will be explained more fully. As mentioned above, two lengths of elastic filaments 10*a* and 10*b* are heat bonded to the fabric at predetermined intervals the width of the fabric may be 70 cm. wide, the length of each piece of elastic may be 15 cm. long, the distance between the edge of the fabric and the elastic filament may be 5 cm. long and the distance between the two pieces of elastic 30 cm. The predetermined interval between each pair of elastic lengths 10*a* and 10*b* may be 25 cm.

FIG. 8 shows how the elastic filament is bonded to the fabric. In this drawing there is only shown the application of one of elastic lengths 10*a* and 10*b* to one side of the fabric for the sake of clarity, however the other elastic length would normally be applied to the other side of the fabric in exactly the same manner. The drawing shows four different operations (a) to (d) which take place during every 25 cm. of fabric movement. An elastic filament 31 and a thermoplastic thread 32 (such as a thread sold under the trade name "Corotex") are fed from a supply thereof (not shown) to two respective guide heads 33 and 34, more clearly shown in FIG. 9. The lower head 33 for the elastic filament is fixed in relation to the guide head for the adhesive thread and includes a curved jamming leaf spring 35, biased against a cooperating shoulder 35*a* on guide head 33. The action of leaf spring allows filament to be drawn through guide head 33 (i.e. movement of filament from right to left in the drawing) but clamps filament against shoulder 35*a* if the filament is pulled in a direction back through guide head 33. The upper head 34 in FIG. 9 also comprises a curved jamming leaf spring 36 and cooperating shoulder 36*a* which acts in the same manner as spring 35 and shoulder 35*a*. Head 34 is also pivoted to swing about axis 37 between the position shown in the continuous and dotted line 5. The reason for this pivoting will be explained later.

Heads 33 and 34 are mounted on a guide means (not shown) which slide the heads 33 and 34 towards rotatable jaws 38. Jaws 38 comprise two pairs of limbs 39 and 40 which act as pincers for gripping filament and thread 31 and 32 as heads 33 and 34 approach limbs 39 and 40, as shown in 8(b). Limbs 39 and 40 may be pneumatically operated. Once filament and thread 31 and 32 have been gripped, head 33 and 34 slide away from jaws 38, and jaws 38 start to rotate as shown in FIG. 8(c). Rotation of the jaws is controlled by any suitable means such as an electronic counter (not shown) which stops the rotation after about 20 twists have been placed in the filament and thread.

After rotation and as shown in 8(d), an ultrasonic head 41 presses down on the twisted filament thread and secures the elastic to the fabric by melting the thermoplastic thread.

Thread cutter 42 (e.g. pneumatically operated thread cutter) then severs the filament and thread at a point between the heads 33, 34 and the ultrasonic head 41.

The elastic thread is secured to the fabric in a stretched condition when the filament is severed, and therefore the length of filament between the guide head 33 and the severing point will contract. The adhesive thread on the other hand will not. The effect of this is that the end of the adhesive thread will extend out from the guide heat 34 more than the elastic filament from guide head 33, making it difficult for the jaws 38 to grip both ends simultaneously. For this reason, guide head 34 is allowed to pivot to the position shown by the dotted line in FIG. 9 after severing, whereby the two thread ends are co-aligned. Jaws 38 and the guide heads 33 and 34 are mounted on a movable platform which moves along the length of the fabric in the direction of the flow of the fabric whilst they perform the operations shown in FIGS. (a) to (d). Once operation (d) has been finished, the jaws 38 and guide heads 33 and 34 return quickly back to the position shown at A. The length of travel between the position shown at (a) and (d) is approximately 25 cm. providing the elastication at 25 cm. intervals.

In practice, a second supply of elastic filament and thermoplastic thread would be fed by a second pair of guide heads to a second pair of pincers on the opposite side of jaws 38 to pincers 39 and 40. The twisted second elastic filament and thermoplastic thread would then be bonded to the fabric in the same manner by a second ultrasonic head to provide the second elastic length. As mentioned above, detailed description of the application of second elastic length has been omitted for the sake of clarity. If it is desired only to elasticate the fabric with one length of elastic, then the second supply of elastic filament and thermoplastic thread, the second guide heads, second pincers and second ultrasonic head would be omitted.

Figure 11:
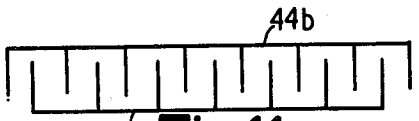
FIGS. 11 and 12 show cross-sectional views of the folding plates of the pleating station.
Figure 12:
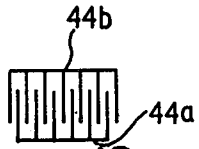

Referring now to FIGS. 10, 11, 12 and 13, there is shown in more detail the pleating station 24. Elasticated fabric 18 is fed around a pleating sheet 43 and through a plurality of guide sheets 44*a* and 44*b*. Guide sheets 44*a* and 44*b* are intermeshed as shown in FIGS. 11 and 12. The spacing of the guide sheets is reduced progressively towards the downstream end, so as to cause the pleats of the fabric to come closer together as the fabric advances through the pleating means.

Pleating sheet 43 comprises a rectangular sheet of metal which has been folded such that the two long edges lie in planes normal to each other. The longer edge adjacent the converging folding plates (i.e. at the downstream end of the metal sheet) is corrugated as shown so as to guide the fabric 18 into the intermeshed guide sheets 44*a* and 44*b*. The upstream long edge is flat. As the pleating sheet has been formed out of rectangular sheet of metal bent to shape, the cross-sectional distance along the metal surface at any point between the two shorter edges remains constant. This ensures that the fabric 18 always conforms to the contours of the pleating sheet 43 which prevents sagging of the material as it enters the guide sheets reducing the friction and reducing strain on the fabric.

Figure 13:
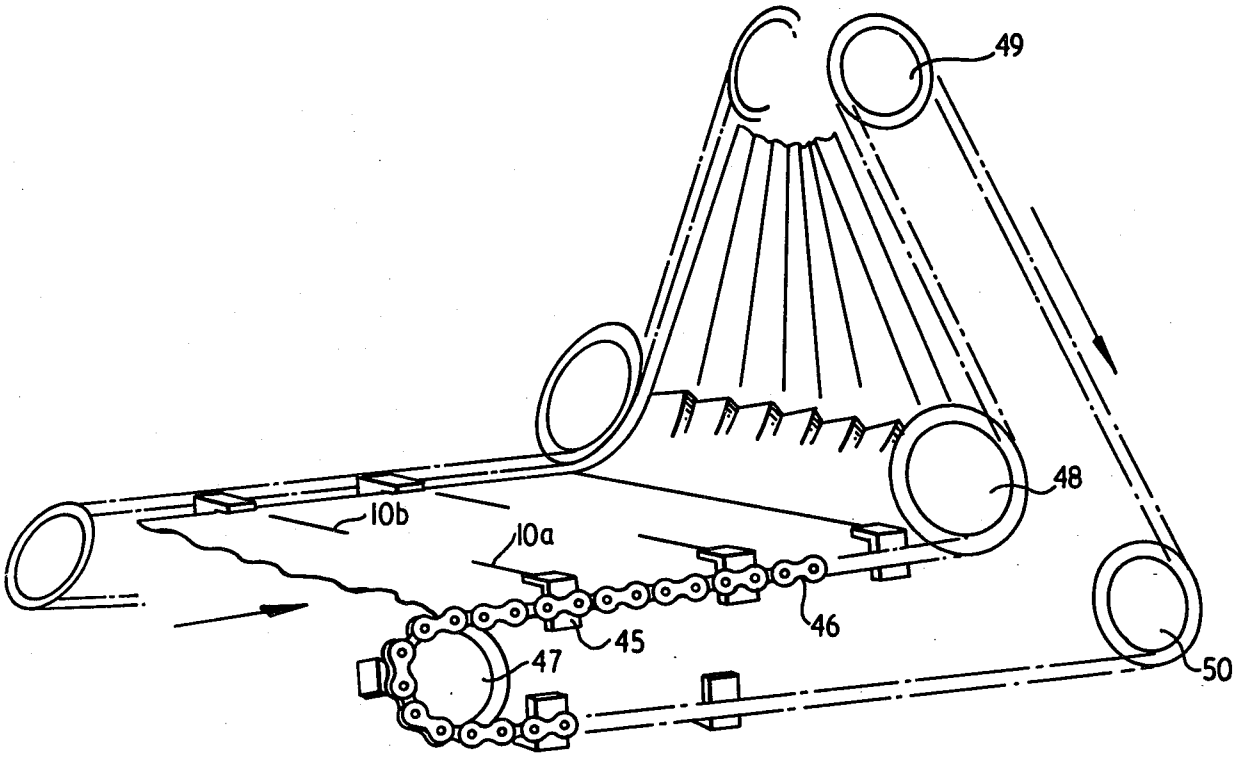
FIG. 13 is a perspective view of an arrangement for carrying fabric through the pleating station.

It will be appreciated that the fabric 18 is elasticated with lengths of elastic 10*a* and 10*b* before it enters the pleating station. The elastic will consequently try to "bunch up" the material as it is applied in the "stretched" state. To prevent this, stentor clips 45 are provided to grip the edges of the fabric at all times up to the apex of the converging plates 44*a* and 44*b*. As shown in FIG. 13, a number of stenter clips 45 are located at spaced intervals on continuous chain 46. In use, a stentor 45 passing over cog 47 will engage the fabric 18. This stentor will then carry the fabric around cog 48 up through guide sheets 44*a* and 44*b* to cog 49 where it will disengage from the fabric and return back to cog 47 via cog 50 for a new cycle. Any mechanical arrangement can be used to engage and disengage the stentor to and from the fabric respectively. In order to facilitate the continuous movement of the chain carrying the stentors and to reduce the strain of the fabric, it is highly desirable that the shorter edge of the pleating sheet 43 which leads to an outer guide sheet be in the same plane as the outer guide sheet as shown. In this manner all the rotational planes of the cogs 47, 48, 49 and 50 and the plane of the chain circulation will be in the same plane.

Figure 14:
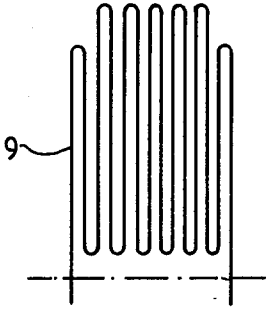
FIGS. 14 and 15 are views of the fabric after pleating, showing an alternative formation of the outer pleats to that shown in FIG. 4.
Figure 15:
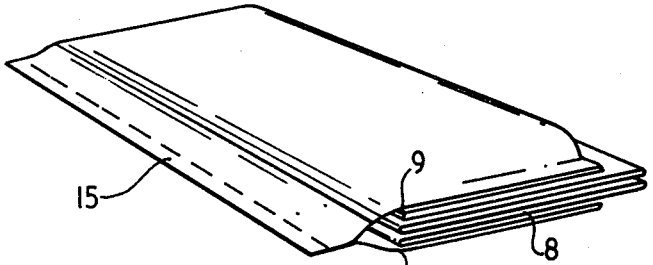

FIGS. 14 and 15 indicate the cross sectional shape of the fabric 18 once it has been passed through the pleating station 24. By staggering the outer guide sheets, the outer pleats 9 are staggered in relation to the inner pleats 8 whereby the end edges extend beyond the inner pleats to ensure that the longitudinal stitch 15 (see FIG. 15) at the longitudinal stitching station does not stitch the inner pleats. Alternatively as described in FIG. 4 the outer pleats may be larger than the inner pleats by using wider outer guide sheets.

Figure 5:
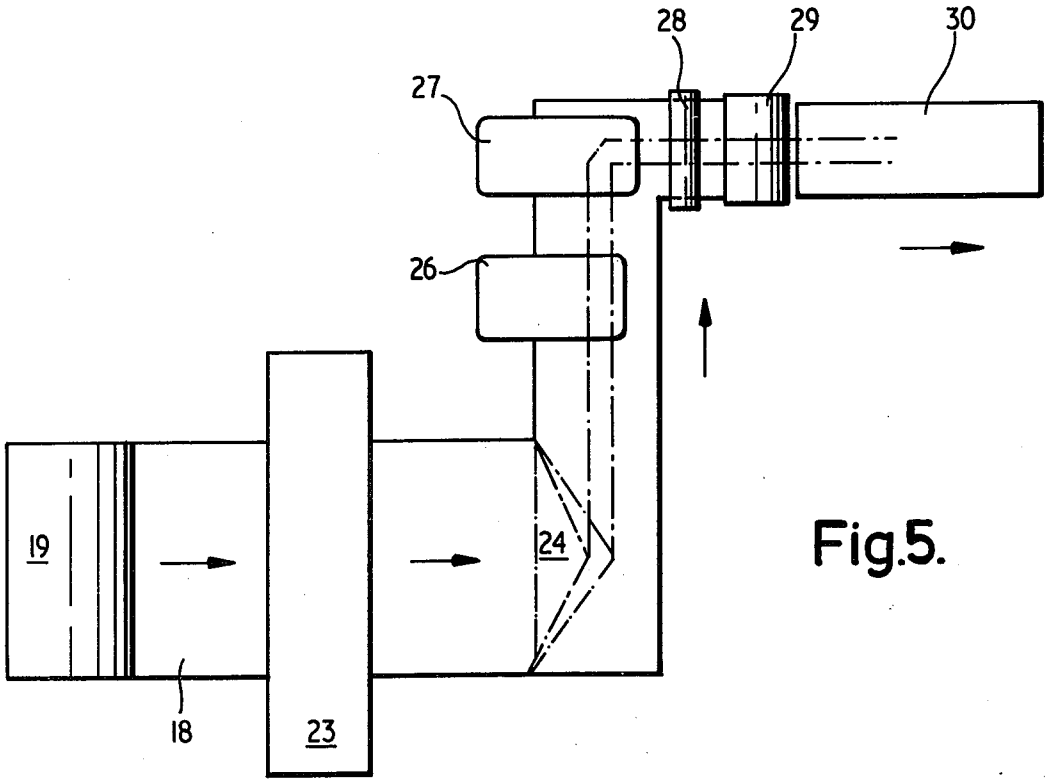
FIG. 5 is a plan view of the apparatus for the production of the nurse's cap.
Figure 6:
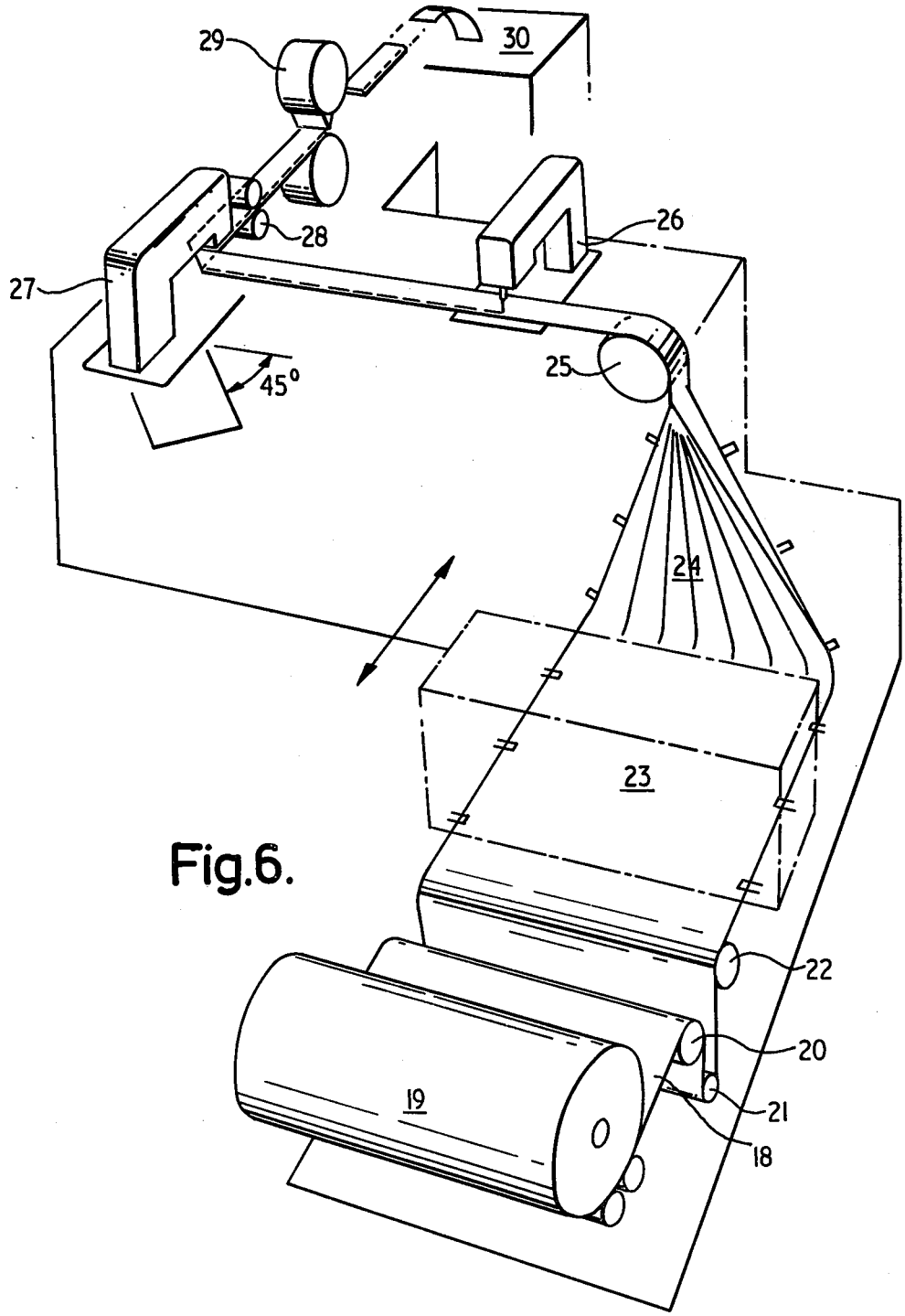
FIG. 6 is a perspective view of the apparatus for the production of the nurse's cap.

As shown in FIGS. 5 and 6, the pleated fabric is passed over roller 25 to compact the pleats together, and then to the cross sewing station 27 via longitudinal sewing station 16. Longitudinal sewing station continuously stitches the outer edges of the fabric together to form the longitudinal stitch 15. Longitudinal sewing station 26 comprises a conventional sewing machine known in the art fixed in a prealigned position.

Figure 16:
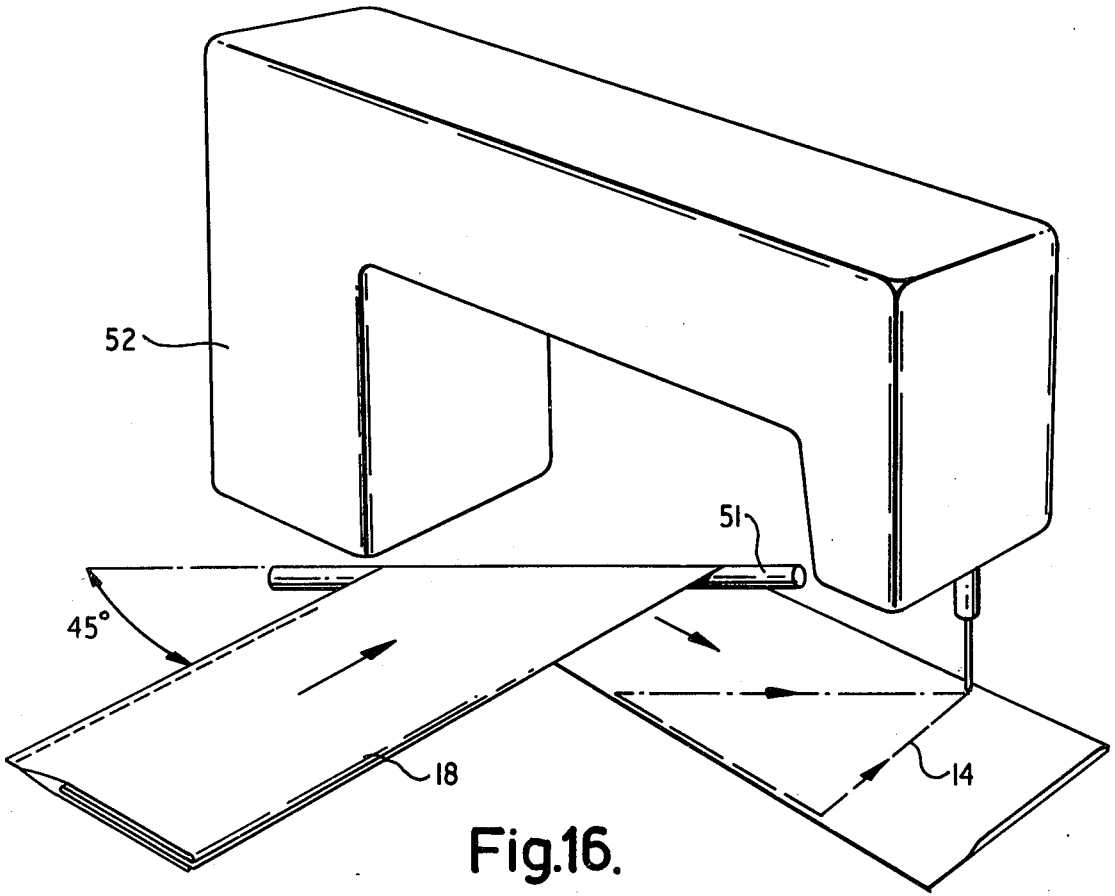
FIG. 16 is a perspective view of the cross-sewing station.

The cross sewing station will now be described with reference to FIG. 16. Pleated fabric 18 from the longitudinal sewing station is turned through 90° over a rod or roller 51 angle at 45° to the direction of flow of the pleated fabric as shown.

In order to stitch cross stitch 14 automatically whilst the fabric is moving, a sewing machine 52 is mounted for movement at 45° to the direction of flow of fabric parallel to rod 51 on any suitable form of guide means such as a track (not shown). As will be seen, the machine will move diagonally across the fabric, but the machine speed is adjusted so that its component of velocity in the direction of the fabric flow is equal to the velocity of the fabric flow. The resultant stitch 14 is therefore in a direction normal to the direction of material flow.

As mentioned hereinabove, each pair of elastic lengths 10*a* and 10*b* are provided in the fabric every 25 cm. Sewing machine 52 is triggered automatically to provide a cross stitch 14 every 25 cm. immediately downstream from the elastic lengths 10*a* and 10*b* as shown in FIG. 17.

Figure 17:
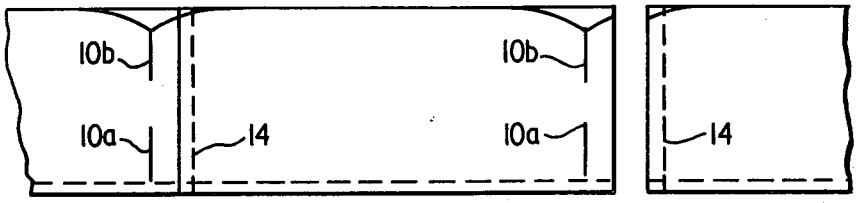
FIG. 17 is a plan view of the pleated fabric after cross-sewing and cutting.

The fabric is then passed through a pair of heated rollers 28 and then it is severed by the cutter 29 between the elastic lengths 10*a* and 10*b* and the cross stitch 14 to provide the hat as also shown in FIG. 17.

The production method described above does not result in any waste of the nonwoven fabric web. All stitching is in straight lines which is easily effected by machinery, and no skilled operatives are required in the production method. Other methods of securing the fabric together instead of stitching may be employed as, for example, bonding by hot-melt adhesive. Moreover, elastication of the web may be effected after, rather than before, the pleating step.

Furthermore, elastication of the fabric may be effected in other ways to the thermoplastic wound elastic filament construction specifically disclosed. For example, an elastic filament could be sewn into the fabric or the elastic filament itself could be coated on its outer surface with thermoplastic material.

Although the present invention has been particularly described above with reference to a nurse's disposable cap, it will be understood that the protective headwear of the present invention may be used in other environments as, for example, laboratories and in the electronics, pharmaceutical, and food industries.

What is claimed is:

1. A disposable protective cap formed from a rectangular sheet of nonwoven fabric having a pair of opposed side edges and a pair of opposed end edges, said sheet being pleated along longitudinal fold-lines parallel to said opposed pair of side edges, and said pair of opposed side edges being secured together, the pleats being secured together at one end of said pleated sheet and the other end being partly elasticated to provide an expandable and contractable opening for the head by means of at least one length of elastic material secured to only a portion of the length of said opening.

2. A cap as claimed in claim 1 wherein the sheet is partly elasticated by two lengths of elastic material.

3. A cap as claimed in claim 1 wherein said elastication is provided by elastic filament.

4. A cap as claimed in claim 3 wherein said elastic filament is attached to said fabric by a thermoplastic thread wound around the filament and heat bonded to the fabric and filament.

5. A cap as claimed in claim 1 wherein said nonwoven fabric is a rearranged or bundled nonwoven fabric, plain nonwoven fabric, or a random laid nonwoven fabric.

6. A cap as claimed in claim 1 wherein the nonwoven fabric is a viscose rayon nonwoven fabric.

7. A cap as claimed in claim 1 wherein the nonwoven fabric is paper.

8. A cap as claimed in claim 1 wherein the nonwoven fabric includes heat-sealable fibres.

9. A cap as claimed in claim 8 wherein the fibres are polyethylene-coated polypropylene.

10. A cap as claimed in claim 1 wherein the nonwoven fabric has a weight of about 10 to 50 g/m$^2$.

11. A cap as claimed in claim 1 wherein said side edges and the pleats are secured by stitching, hot-melt adhesive, heat sealing or ultrasonic or dielectric welding, or stapling.

12. A method of producing, a disposable protective cap comprising the steps of advancing a web of nonwoven fabric to a pleating station, pleating said web along longitudinal fold-lines parallel to the opposed side edges of said web, compacting the pleats together, securing together the side edges of a length of said pleated web, securing together the pleats of said pleated length at one end of said length, severing said length from said web, and partly elasticating said web or said length transversely of said web or length by means of at least one length of elastic material being secured to a portion of the other end of said length of web to provide an expandable and contractable opening into said length.

13. A method as claimed in claim 12 wherein said elasticating step is effected prior to pleating.

14. A method as claimed in claim 12 wherein said elasticating step comprises heat bonding elastic filament to the fabric.

15. A method as claimed in claim 14 wherein thermoplastic thread is twisted with elastic filament and heat bonded to the fabric.

16. A method as claimed in claim 12 wherein said elasticating step comprises securing two lengths of elastic material to the fabric for each cap.

17. A method as claimed in claim 12 wherein the securing together of the side edges and the pleats is effected by stitching, hot-melt adhesive, heat sealing, ultrasonic or dielectric welding or stapling.

* * * * *